US010086244B2

(12) United States Patent
Morin et al.

(10) Patent No.: US 10,086,244 B2
(45) Date of Patent: Oct. 2, 2018

(54) GOLF CLUB HAVING AN ELASTOMER ELEMENT FOR BALL SPEED CONTROL

(71) Applicant: Acushnet Company, Fairhaven, MA (US)

(72) Inventors: John Morin, Poway, CA (US); Charles E. Golden, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 15/220,122

(22) Filed: Jul. 26, 2016

(65) Prior Publication Data

US 2018/0028883 A1 Feb. 1, 2018

(51) Int. Cl.
*A63B 53/04* (2015.01)
*A63B 53/06* (2015.01)
*A63B 53/08* (2015.01)

(52) U.S. Cl.
CPC ..... *A63B 53/08* (2013.01); *A63B 53/047* (2013.01); *A63B 53/06* (2013.01)

(58) Field of Classification Search
CPC ..... A63B 53/08; A63B 53/06; A63B 53/047; A63B 53/04; A63B 60/54
USPC ..... 473/324–350, 287–292
See application file for complete search history.

(56) References Cited

U.S. PATENT DOCUMENTS 1,133,129 A * 3/1915 Govan ..... A63B 53/047 473/337
2,111,249 A * 3/1938 Plese ..... A63B 69/36 473/233
3,817,522 A * 6/1974 Simmons ..... A63B 53/04 273/DIG. 3
4,195,842 A * 4/1980 Coleman ..... A63B 53/04 29/415
4,398,965 A * 8/1983 Campau ..... A63B 53/04 148/522
4,754,977 A * 7/1988 Sahm ..... A63B 53/04 473/337
5,121,922 A * 6/1992 Harsh, Sr. ..... A63B 53/04 473/251
5,346,213 A * 9/1994 Yamada ..... A63B 53/04 473/329
5,464,211 A * 11/1995 Atkins, Sr. ..... A63B 53/04 473/346
5,492,327 A * 2/1996 Biafore, Jr. ..... A63B 53/04 473/332
5,628,697 A * 5/1997 Gamble ..... A63B 21/0602 473/326
5,888,148 A * 3/1999 Allen ..... A63B 53/04 473/290
5,890,973 A * 4/1999 Gamble ..... A63B 21/0602 473/326

(Continued)

*Primary Examiner* — Sebastiano Passaniti

(57) ABSTRACT

A golf club has a club head body with a back portion and striking face. A cradle is attached to an internal surface of the back portion, and an elastomer extends from the cradle towards a rear surface of the striking face. The golf club head may also have an adjustment mechanism operatively connected to the elastomer and the back portion of the golf club. Adjustment of the adjustment mechanism causes a change in compression of the elastomer element. The adjustment mechanism may be a threaded element such as a screw, and the golf club head may be a part of a kit included multiple differently weighted screws.

20 Claims, 7 Drawing Sheets

(56) References Cited

U.S. PATENT DOCUMENTS 6,855,066 B2 * 2/2005 Best ..... A63B 53/04 473/291
6,991,559 B2 * 1/2006 Yabu ..... A63B 53/04 473/332
7,140,977 B2 * 11/2006 Atkins, Sr. ..... A63B 53/0466 473/346
7,575,523 B2 * 8/2009 Yokota ..... A63B 53/0466 473/332
7,582,024 B2 * 9/2009 Shear ..... A63B 53/0466 473/329
7,588,503 B2 * 9/2009 Roach ..... A63B 53/047 473/332
7,597,633 B2 * 10/2009 Shimazaki ..... A63B 53/047 473/329
7,713,141 B2 * 5/2010 Yamamoto ..... A63B 53/047 473/332
7,749,100 B2 * 7/2010 Tavares ..... A63B 53/0475 473/332
7,967,700 B2 * 6/2011 Stites ..... A63B 53/0466 473/342
8,157,673 B2 * 4/2012 Gilbert ..... A63B 53/047 473/350
8,210,961 B2 * 7/2012 Finn ..... A63B 53/0466 473/244
8,267,807 B2 * 9/2012 Takechi ..... A63B 53/0475 473/332
8,562,652 B2 * 10/2013 Biedermann ..... A61B 17/8605 606/266
8,608,585 B2 * 12/2013 Stites ..... A63B 53/04 473/282
8,821,307 B2 * 9/2014 Park ..... A63B 53/04 473/244
2005/0277485 A1 * 12/2005 Hou ..... A63B 53/047 473/332
2007/0026961 A1 * 2/2007 Hou ..... A63B 53/0466 473/329
2009/0163295 A1 * 6/2009 Tseng ..... A63B 53/0475 473/346
2010/0056297 A1 * 3/2010 Roach ..... A63B 53/047 473/332
2010/0273565 A1 * 10/2010 Stites ..... A63B 53/04 473/282
2011/0250985 A1 * 10/2011 Stites ..... A63B 53/047 473/332

* cited by examiner

GOLF CLUB HAVING AN ELASTOMER ELEMENT FOR BALL SPEED CONTROL

BACKGROUND

It is a goal for golfers to reduce the total number of swings needed to complete a round of golf, thus reducing their total score. To achieve that goal, it is generally desirable to for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club.

SUMMARY

In one aspect, the technology relates to an iron-type golf club head, having: a club head body having a back portion and a striking face; a cradle attached to an internal surface of the back portion; and an elastomer extending from the cradle towards a rear surface of the striking face. In an embodiment, the iron-type golf club head further includes an adjustment mechanism operatively connected to the elastomer and the back portion, wherein the adjustment mechanism is configured to adjust a compression of the elastomer. In another embodiment, the adjustment mechanism includes a screw having a screw drive at least partially external to the club head body and wherein the screw is engaged with the cradle. In yet another embodiment, the back portion includes a threaded hole for receiving the screw such that turning of the screw adjusts the compression of the elastomer. In still another embodiment, the elastomer displays an elastic modulus of about 1 to about 40 gigapascals (GPa).

In another embodiment of the above aspect, the iron-type golf club head further includes a sole connecting the back portion to the striking face, wherein the sole at least partially defines a channel. In an embodiment, the cradle encompasses at least 25% of a volume of the elastomer. In another embodiment, the cradle is formed to substantially match a shape of a rear portion of the elastomer. In yet another embodiment, the iron-type golf club head further includes a securing structure attached to the rear surface of the striking face, the securing structure configured to secure the elastomer to a position on the rear surface of the striking face.

In another aspect, the technology relates to an iron-type golf club head having: a club head body having a back portion and a striking face; an elastomer in contact with a rear surface of the striking face; and an adjustment mechanism operatively connected to the elastomer, wherein the adjustment mechanism is configured to adjust a compression of the elastomer. In an embodiment, the adjustment mechanism includes a screw having a screw drive at least partially external to the club head body and an interface operatively connected to the elastomer. In another embodiment, the back portion includes a threaded hole for receiving the screw such that turning of the screw adjusts the compression of the elastomer. In yet another embodiment, the interface includes a cradle at least partially encompassing the elastomer, wherein the cradle is in contact with the adjustment mechanism. In still another embodiment, the elastomer displays an elastic modulus of about 1 to about 50 GPa.

In another embodiment of the above aspect, the elastomer displays an elastic modulus of about 4 to about 15 GPa. In an embodiment, the back portion further includes a cradle at least partially encompassing the elastomer. In another embodiment, a portion of the striking face in contact with the elastomer has a thickness different from a thickness of another portion of the striking face. In yet another embodiment, the iron-type golf club head further includes a securing structure attached to the rear surface of the striking face, the securing structure configured to secure the elastomer to a position on the rear surface of the striking face.

In another aspect, the technology relates to a kit for assembling an iron-type golf club, the kit includes: a club head body having a back portion and a striking face; an elastomer having a first portion in contact with a rear surface of the striking face and a second portion in contact with a cradle; a set of differently weighted adjustment drivers; and an adjustment receiver incorporated in the back portion, wherein the adjustment mechanism is configured to receive an adjustment driver that, when manipulated, adjusts a compression of the elastomer between the back portion and the striking face. In an embodiment, the set of differently weighted adjustment drivers includes a set of differently weighted screws, and wherein the adjustment receiver is a threaded hole extending through the back portion.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate an iron-type golf club head that incorporates an elastomer element to promote more uniform ball speed across the striking face of the golf club. Traditional thin-faced iron-type golf clubs generally produce less uniform launch velocities across the striking face due to increased compliance at the geometric center of the striking face. For example, when a golf club strikes a golf ball, the striking face of the club deflects and then springs forward, accelerating the golf ball off the striking face. While such a design may lead to large flight distances for a golf ball when struck in the center of the face, any off-center strike of golf ball causes significant losses in flight distance of the golf ball. In comparison, an extremely thick face causes more uniform ball flight regardless of impact location, but a significant loss in launch velocities. The present technology incorporates an elastomer element between a back portion of the hollow iron and the rear surface of the striking face. By including the elastomer element, the magnitude of the launch velocity may be reduced for strikes at the center of the face while improving uniformity of launch velocities across the striking face. In some examples, the compression of the elastomer element between the back portion and the striking face may also be adjustable to allow for a golfer or golf club fitting professional to alter the deflection of the striking face when striking a golf ball.

Figure 1B:
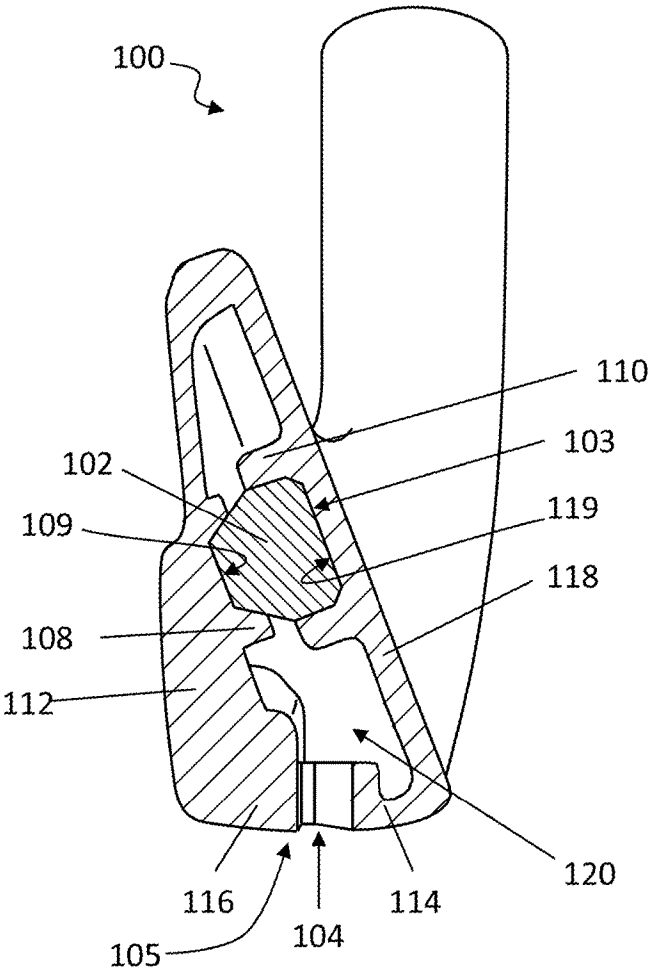
FIGS. 1A-1B depict section views of a golf club head having an elastomer element.
Figure 1A:
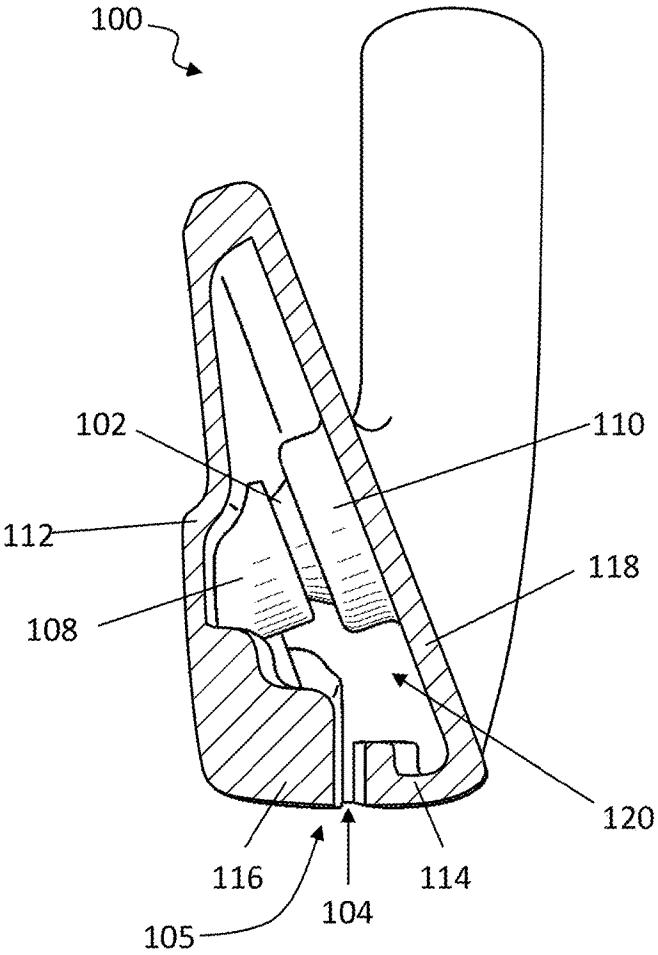
Figure 1C:
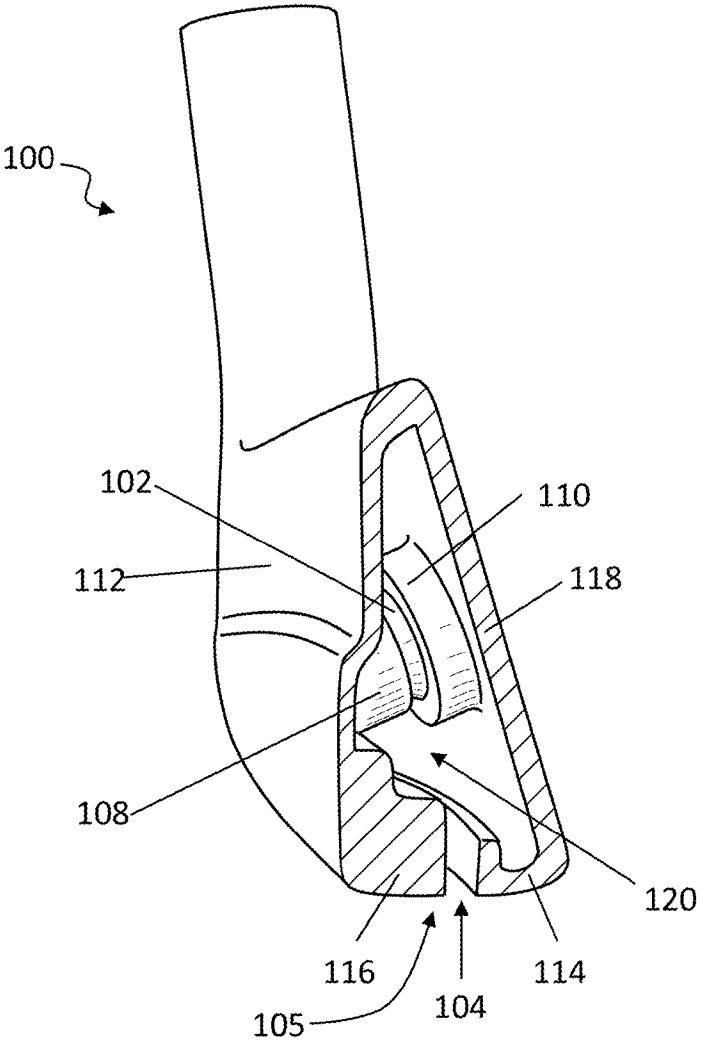
FIG. 1C depicts a perspective section view of the golf club head depicted in FIGS. 1A-1B.

FIGS. 1A-1B depict section views depict section views of a golf club head 100 having an elastomer element 102. FIG. 1C depicts a perspective section view of the golf club head 100. FIGS. 1A-1C are described concurrently. The club head 100 includes a striking face 118 and a back portion 112. A cavity 120 is formed between the striking face 118 and the back portion 112. An elastomer element 102 is disposed in the cavity 120 between the striking face 118 and the back portion 112. A rear portion of the elastomer element 102 is held in place by a cradle 108. The cradle 108 is attached to the back portion 112 of the golf club head 100, and the cradle 108 includes a recess 109 to receive the rear portion of the elastomer element 102. The lip of the cradle 108 prevents the elastomer element 102 from sliding or otherwise moving out of position. The elastomer element 102 may have a generally frustoconical shape, as shown in FIGS. 1A-1B. In other examples, the elastomer element 102 may have a cylindrical, spherical, cuboid, or prism shape. The recess 109 of the cradle 108 is formed to substantially match the shape of the rear portion of the elastomer element 102. For example, with the frustoconical elastomer element 102, the recess 109 of the cradle 108 is also frustoconical such that the surface of the rear portion of the elastomer element 102 is in contact with the interior walls of the recess 109 of the cradle 108. The cradle 108 may be welded or otherwise attached onto the back portion 112, or the cradle 108 may be formed as part of the back portion 112 during a casting or forging process. The back portion 112 may also be machined to include the cradle 108.

A front portion 103 of the elastomer element 102 contacts the rear surface 119 of the striking face 118. The front portion 103 of the elastomer element 102 may be held in place on the rear surface 119 of the striking face 118 by a securing structure, such as flange 110. The flange 110 protrudes from the rear surface 119 of the striking face 118 into the cavity 120. The flange 110 receives the front portion 103 of the elastomer element 102 to substantially prevent the elastomer element 102 from sliding along the rear surface 119 of the striking face 118. The flange 110 may partially or completely surround the front portion 103 of the elastomer element 102. Similar to the cradle 108, the flange 110 may be shaped to match the shape of the front portion 103 of the elastomer element 102 such that the surface of the front portion 103 of the elastomer element 102 is in contact with the interior surfaces of the flange 110. The flange 110 may be welded or otherwise attached to the rear surface 119 of the striking face 118. The flange 110 may also be cast or forged during the formation of the striking face 118. For instance, where the striking face 118 is a face insert, the flange 110 may be incorporated during the casting or forging process to make the face insert. In another example, the flange 110 and the striking face 118 may be machined from a thicker face plate. Alternative securing structures other than the flange 110 may also be used. For instance, two or more posts may be included on rear surface 119 of the striking face 118 around the perimeter of the front portion 103 of the elastomer element 102. As another example, an adhesive may be used to secure the elastomer element 102 to the rear surface 119 of the striking face 118. In other embodiments, no securing structure is utilized and the elastomer element 102 is generally held in place due to the compression of the elastomer element 102 between the cradle 108 and the rear surface 119 of the striking face 118.

In the example depicted in FIGS. 1A-1C, the elastomer element 102 is disposed behind the approximate geometric center of the striking face 118. In traditional thin face golf clubs, strikes at the geometric center of the striking face 118 display the largest displacement of the striking face 118, and thus the greatest ball speeds. By disposing the elastomer 102 at the geometric center of the striking face 118, the deflection of the striking face 118 at that point is reduced, thus reducing the ball speed. Portions of the striking face 118 not backed by the elastomer element 102, however, continue to deflect into the cavity 120 contributing to the speed of the golf ball. As such, a more uniform distribution of ball speeds resulting from ball strikes across the striking face 118 from the heel to the toe may be achieved. In other examples, the elastomer element 102 may be disposed at other locations within the club head 100.

The elasticity of the elastomer element 102 also affects the deflection of the striking face 118. For instance, a material with a lower elastic modulus allows for further deflection of the striking face 118, providing for higher maximum ball speeds but less uniformity of ball speeds. In contrast, a material with a higher elastic modulus further prevents deflection of the striking face 118, providing for lower maximum ball speeds but more uniformity of ball speeds. Different types of materials are discussed in further detail below with reference to Tables 2-3.

The golf club head 100 also includes a sole 105 having a sole channel 104 in between a front sole portion 114 and a rear sole portion 116. The sole channel 104 extends along the sole 105 of the golf club head 100 from a point near the heel to a point near the toe thereof. While depicted as being a hollow channel, the sole channel 104 may be filled or spanned by a plastic, rubber, polymer, or other material to prevent debris from entering the cavity 120. The sole channel 104 allows for additional deflection of the lower portion of the striking face 118. By allowing for further deflection of the lower portion of the striking face 118, increased ball speeds are achieved from ball strikes at lower portions of the striking face 118, such as ball strikes off the turf. Accordingly, the elastomer element 102 and the sole channel 104 in combination with one another provide for increased flight distance of a golf ball for turf strikes along with more uniform ball speeds across the striking face 118.

Figure 2B:
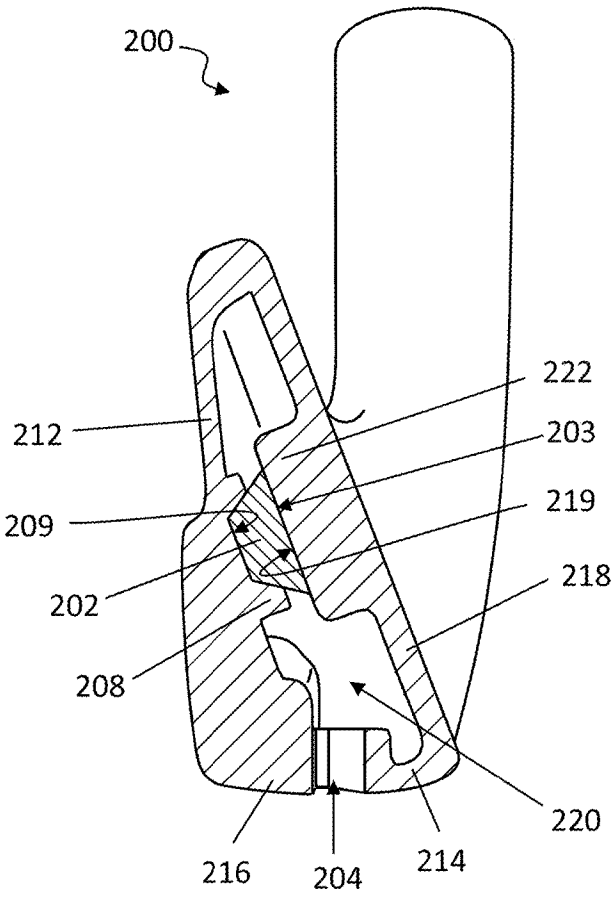
FIGS. 2A-2B depict section views of a golf club head having an elastomer element and a striking face with a thickened center portion.
Figure 2A:
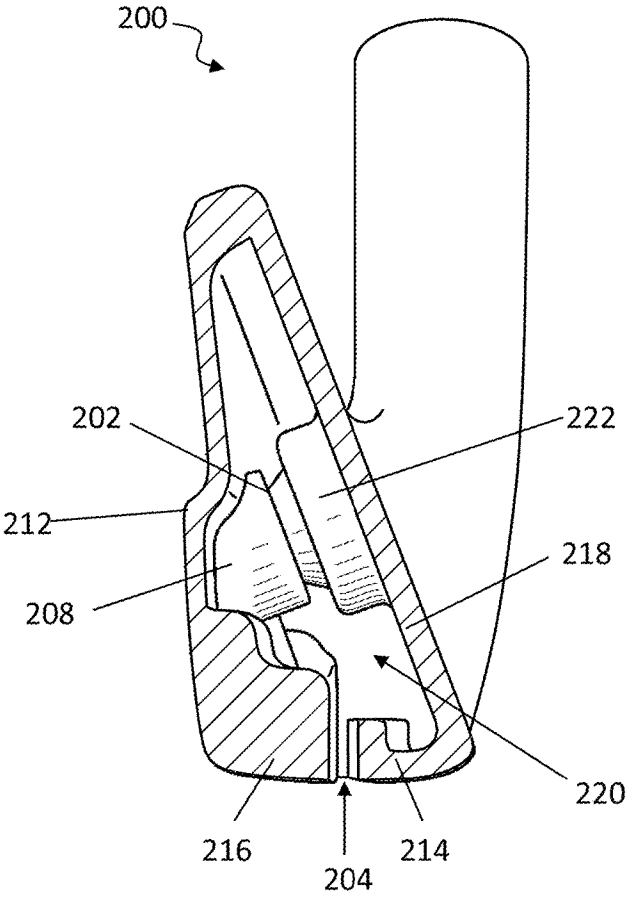

FIGS. 2A-2B depict sections views of a golf club head 200 having an elastomer element 202 and a striking face 218 with a thickened center portion 222. Golf club head 200 is similar to golf club head 100 discussed above with reference to FIGS. 1A-1C, except a thickened portion 222 of the striking face 218 is utilized rather than a flange 110. The thickened portion 222 of the striking face 218 protrudes into the cavity 220. The front portion 203 of the elastomer element 202 contacts the rear surface 219 of the thickened portion 222. The rear portion of the elastomer element 202 is received by a recess 209 in a cradle 208, which is attached to the back portion 212 and substantially similar to the cradle 108 discussed above with reference to FIGS. 1A-1C. Due the thickened portion 222 of the striking face 218, the elastomer element 202 may be shorter in length than the elastomer element 102 in FIGS. 1A-1C. The golf club head 200 also includes a sole channel 204 disposed between a front sole portion 214 and a rear sole portion 216. The sole channel 204 also provides benefits similar to that of sole channel 104 described in FIGS. 1A-1C and may also be filled with or spanned by a material.

Figure 3B:
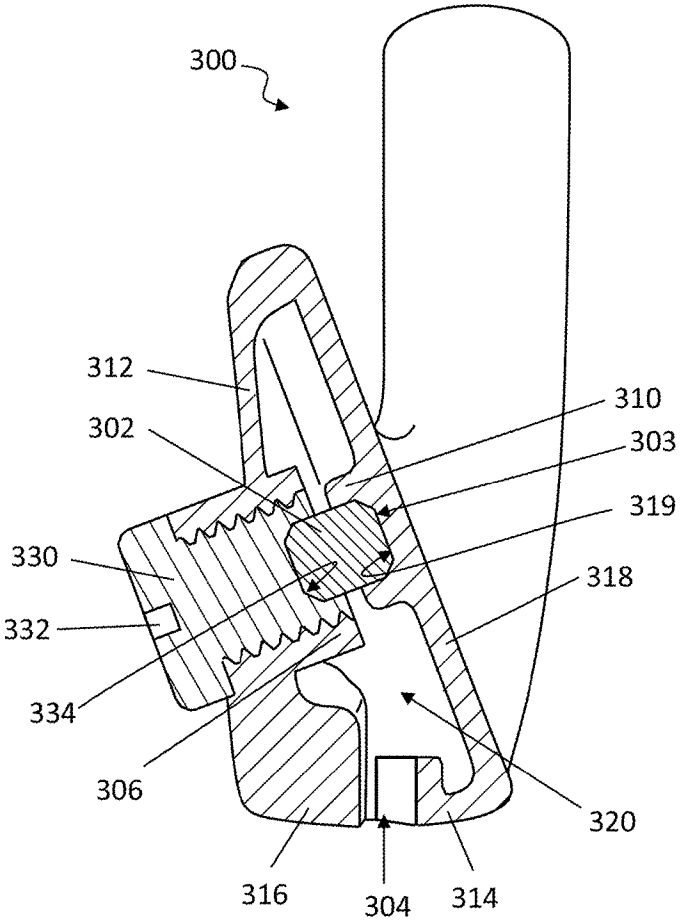
FIGS. 3A-3B depict section views of a golf club head having an elastomer element and an adjustment mechanism to adjust the compression of the elastomer element.
Figure 3A:
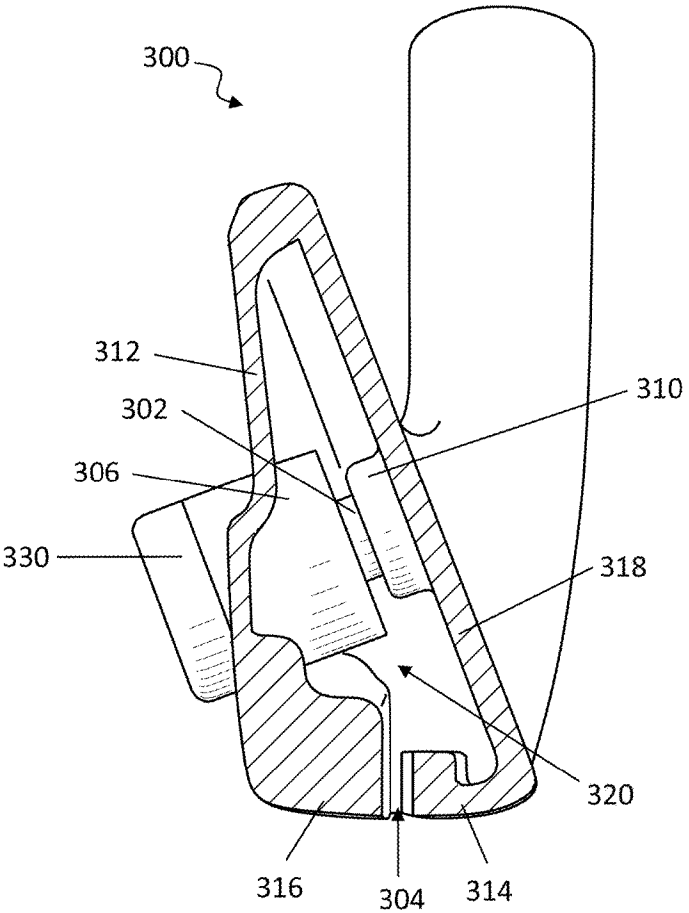

FIGS. 3A-3B depict section views of a golf club head 300 having an elastomer element 302 and an adjustment mechanism to adjust the compression of the elastomer element 302. The golf club head 300 includes a striking face 318 and a back portion 312, and a cavity 320 is formed between the back portion 312 and the striking face 318. Similar to the golf club head 100 described above with reference to FIGS. 1A-1C, a flange 310 is disposed on the rear surface 319 of the striking face 318, and the flange 310 receives the front portion 303 of the elastomer element 302. In the example depicted in FIGS. 3A-3B, the elastomer element 302 has a generally cylindrical shape. In other examples, however, the elastomer element 302 may have a conical, frustoconical, spherical, cuboid, or prism shape.

The golf club head 300 also includes an adjustment mechanism. The adjustment mechanism is configured to adjust the compression of the elastomer element 302 against the rear surface 319 of the striking face 318. In the embodiment depicted in FIGS. 3A-3B, the adjustment mechanism includes an adjustment receiver 306 and an adjustment driver 330. The adjustment receiver 306 may be a structure with a through-hole into the cavity 320, and the adjustment driver 330 may be a threaded element or screw, as depicted. The through-hole of the adjustment receiver 306 includes a threaded interior surface for receiving the threaded element 330. The adjustment receiver 306 may be formed as part of the forging or casting process of the back portion 312 or may also be machined and tapped following the forging and casting process. The threaded element 330 includes an interface 334, such as a recess, that contacts or receives a rear portion of the elastomer element 302. The threaded element 330 also includes a screw drive 332 that is at least partially external to the golf club head 300 such that a golfer can access the screw drive 332. When the threaded element 330 is turned via screw drive 332, such as by a screwdriver, Allen wrench, or torque wrench, the threaded element 330 moves further into or out of the cavity 320. In some examples, the interface 334 that contacts or receives the rear portion of the elastomer element 302 may be lubricated so as to prevent twisting or spinning of the elastomer element 302 when the threaded element 330 is turned. As the threaded element 330 moves further into the cavity 320, the compression of the elastomer element 302 against the rear surface 319 of the striking face 318 increases, thus altering a performance of the elastomer element 302.

A higher compression of the elastomer element 302 against the rear surface 319 of the striking face 318 further restricts the deflection of the striking face 318. In turn, further restriction of the deflection causes more uniform ball speeds across the striking face 318. However, the restriction on deflection also lowers the maximum ball speed from the center of the striking face 318. By making the compression of the elastomer element 302 adjustable with the adjustment mechanism, the golfer or a golf-club-fitting professional may adjust the compression to fit the particular needs of the golfer. For example, a golfer that desires further maximum distance, but does not need uniform ball speed across the striking face 318, can reduce the initial set compression of the elastomer element 302 by loosening the threaded element 330. In contrast, a golfer that desires uniform ball speed across the striking face 318 can tighten the threaded element 330 to increase the initial set compression of the elastomer element 302.

While the adjustment mechanism is depicted as including a threaded element 330 and a threaded through-hole in FIGS. 3A-3B, other adjustment mechanisms could be used to adjust the compression of the elastomer element 302 against the rear surface 319 of the striking face 318. For instance, the adjustment mechanism may include a lever where rotation of the lever alters the compression of the elastomer element 302. The adjustment mechanism may also include a button that may be depressed to directly increase the compression of the elastomer element 302. Other types of adjustment mechanisms may also be used.

The golf club head 300 also includes a sole channel 304 between a front sole portion 314 and a rear sole portion 316, similar to the sole channel 104 discussed above with reference to FIGS. 1A-1C. The sole channel 304 also provides benefits similar to that of sole channel 104 and may also be filled with or spanned by a material.

The golf club head 300 may also be created or sold as a kit. In the example depicted where the adjustment mechanism is a threaded element 330, such as a screw, the kit may include a plurality of threaded elements 330. Each of the threaded elements 330 may have a different weight, such that the golfer can select the desired weight. For example, one golfer may prefer an overall lighter weight for the head of an iron, while another golfer may prefer a heavier weight. The plurality of threaded elements 330 may also each have different weight distributions. For instance, different threaded elements 330 may be configured so as to distribute, as desired, the weight of each threaded element 330 along a length thereof. The plurality of threaded elements 330 may also have differing lengths. By having differing lengths, each threaded elements 330 may have a maximum compression that it can apply to the elastomer element 302. For instance, a shorter threaded elements 330 may not be able to apply as much force onto the elastomer element 302 as a longer threaded elements 330, depending on the configuration of the adjustment receiver 306. The kit may also include a torque wrench for installing the threaded elements 330 into the adjustment receiver 306. The torque wrench may include preset settings corresponding to different compression or performance levels.

Figure 4B:
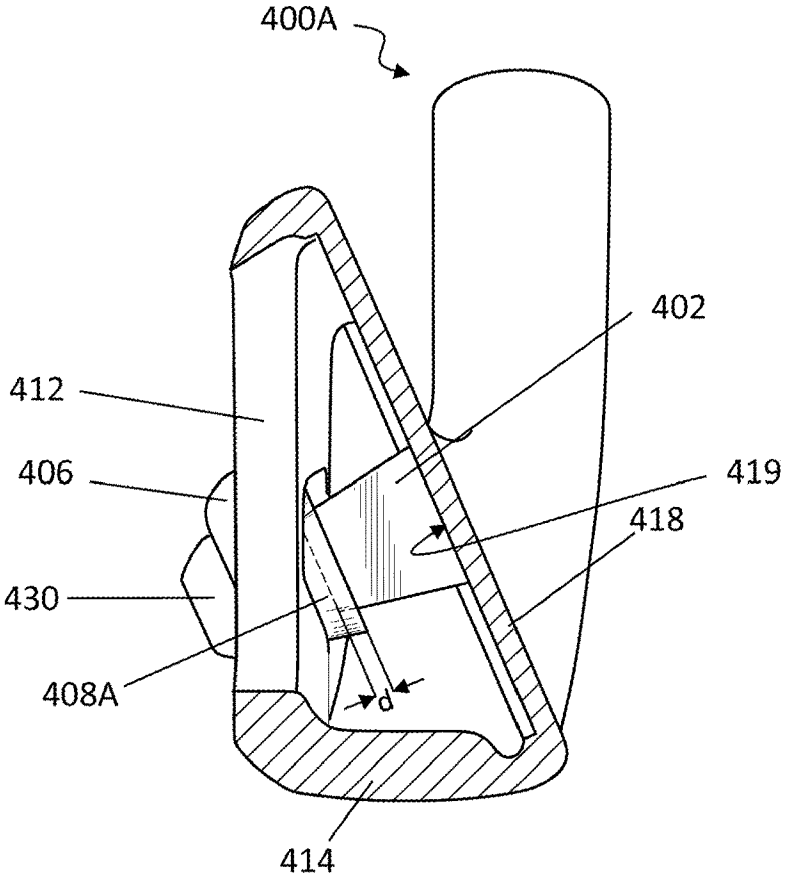
FIG. 4B depicts a section view of the golf club head of FIG. 4A.
Figure 4A:
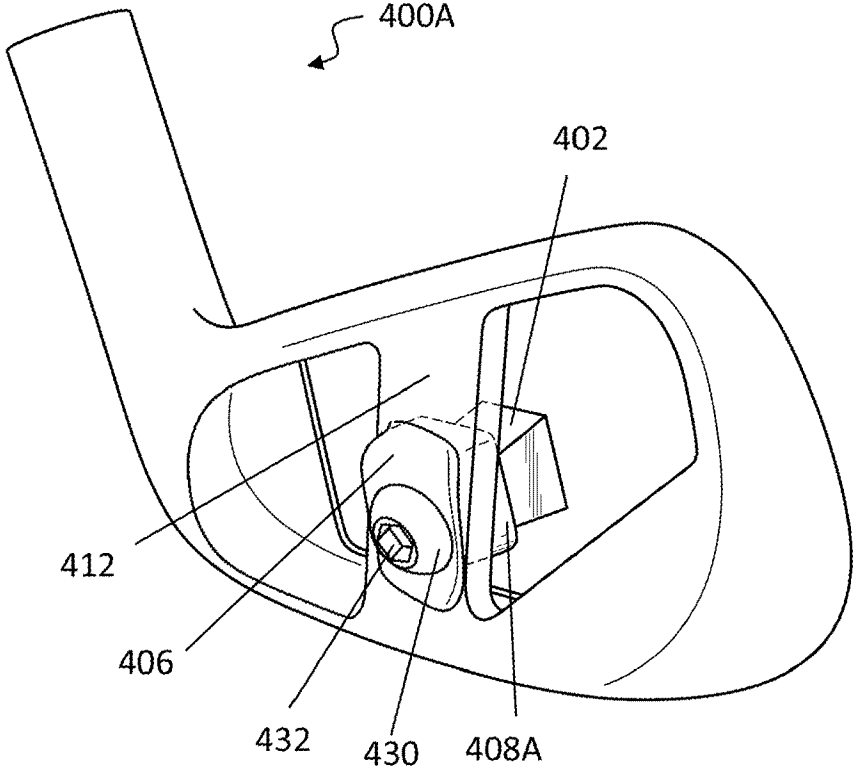
FIG. 4A depicts a perspective view of another example of a golf club head having an elastomer element and an adjustment mechanism to adjust the compression of the elastomer element.

FIG. 4A depicts a perspective view of another example of a golf club head 400A having an elastomer element 402 and an adjustment mechanism to adjust the compression of the elastomer element 402. FIG. 4B depicts a section view of the golf club head 400A. The golf club 400A includes striking face 418 and a back portion 412 with a cavity 420 formed there between. Like the adjustment mechanism in FIGS. 3A-3B, the adjustment mechanism in golf club head 400A includes an adjustment receiver 406 and an adjustment driver 430. In the example depicted, the adjustment receiver 406 is a structure having a threaded through-hole for accepting the adjustment driver 430, and the adjustment driver 430 is a screw. In some embodiments, the adjustment receiver 406 may be defined by a threaded through-hole through the back portion 412, without the need for any additional structure.

The tip of the screw 430 is in contact with a cradle 408A that holds a rear portion of the elastomer element 402. As the screw 430 is turned, the lateral movement of the screw 430 causes the cradle 408A to move towards or away from the striking face 418. Accordingly, in some examples, the screw 430 extends substantially orthogonal to the rear surface 419 of the striking face 418. Because the cradle 408A holds the rear portion of the elastomer element 402, movement of the cradle 408A causes a change in the compression of the elastomer element 402 against the rear surface 419 of the striking face 418. As such, the compression of the elastomer element 402 may be adjusted by turning the screw 430 via screw drive 432, similar to manipulation of the threaded element 330 in golf club head 300 depicted in FIGS. 3A-3B.

Figure 4C:
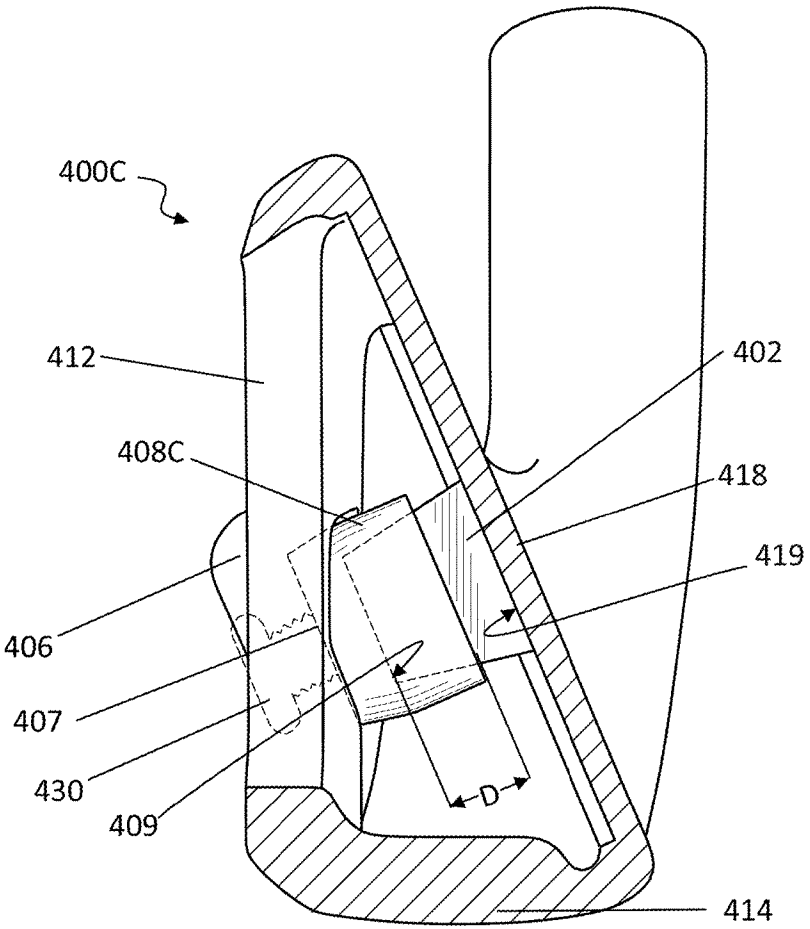
FIG. 4C depicts a section view of another example of a golf club having an elastomer element and an adjustment mechanism to adjust the compression of the elastomer element.

FIG. 4C depicts a section view of another example of a golf club 400C having an elastomer element 402 and an adjustment mechanism to adjust the compression of the elastomer element 402. The golf club head 400C is substantially similar to the golf club head 400A depicted in FIGS. 4A-4B, except golf club head 400C includes a larger cradle 408C having a depth D greater than a depth of a comparatively smaller cradle (e.g., the cradle 408A of FIGS. 4A-4B having a depth d). The larger cradle 408C encompasses more the elastomer element 402 than a smaller cradle. By encompassing a larger portion of the elastomer element 402, the cradle 408C further limits the deformation of the elastomer element 402 upon a strike of a golf ball by golf club head 400C. Limitation of the deformation of the elastomer element 402 also may limit the potential maximum deflection of the striking face 418, and therefore may reduce the maximum ball speed for the golf club head 400C while increasing the uniformity of speeds across the striking face 418. The larger cradle 408C does not come into contact with the rear surface 419 of the striking face 418 at maximum deflection thereof. The cradle 408C itself may be made of the same material as the back portion 412, such as a steel. The cradle 408C may also be made from a titanium, a composite, a ceramic, or a variety of other materials.

The size of the cradle 408C may be selected based on the desired ball speed properties. For instance, the cradle 408C may encompass approximately 25% or more of the volume of the elastomer element 402, as shown in FIG. 4C. In other examples, the cradle 408C may encompass between approximately 25%-50% of the volume of the elastomer element 402. In yet other examples, the cradle 408C may encompass approximately 10%-25% or less than approximately 10% of the volume of the elastomer element 402. In still other examples, the cradle 408C may encompass more than 50% of the volume of the elastomer element 402. For the portion of the elastomer element 402 encompassed by the cradle 408C, substantially the entire perimeter surface of that portion of elastomer element 402 may contact the interior surfaces of the recess 409 of the cradle 408C.

The connection between the cradle 408C and the adjustment driver 430 can also be seen more clearly in FIG. 4C. The tip of the adjustment driver 430, which may be a flat surface, contacts the rear surface 407 of the cradle 408C. Thus, as the adjustment driver 430 moves into the cavity 420, the cradle 408C and the elastomer element 402 are pushed towards the striking face 418. Conversely, as the adjustment driver 430 is backed out of the cavity 420, the cradle 408C maintains contact with the adjustment driver 430 due to the force exerted from the elastomer element 402 resulting from the compression thereof. In some embodiments, the surface of the tip of the screw 430 and/or the rear surface 407 of the cradle 408C may be lubricated so as to prevent twisting of the cradle 408C. In other examples, the tip of the adjustment driver 430 may be attached to the cradle 408C such that the cradle 408C twists with the turning of the adjustment driver 430. In such an embodiment, the elastomer element 402 may be substantially cylindrical, conical, spherical, or frustoconical, and the interior 409 of the cradle 408C may be lubricated to prevent twisting of the elastomer element 402. In another example, the rear surface 419 of the striking face 418 and/or the front surface of the elastomer element 402 in contact with the rear surface 419 of the striking face 418 may be lubricated so as to allow for spinning of the elastomer element 402 against the rear surface 419 of the striking face 418.

While the golf club heads 400A and 400C are depicted with a continuous sole 414 rather than a sole channel like the golf club head 300 of FIGS. 3A-3B, other embodiments of golf club heads 400A and 400C may include a sole channel. In addition, golf club heads 400A and 400C may also be sold as kits with a plurality of screws and/or a torque wrench, similar to the kit discussed above for golf club head 300. An additional back plate may be added to the aft portion of the golf club heads 400A and 400C, while still leaving a portion of the screw exposed for adjustment.

Simulated results of different types of golf club heads further demonstrate ball speed uniformity across the face of the golf club heads including an elastomer element. Table 1 indicates ball speed retention across the face of a golf club head for several different example golf club heads. Example 1 is a baseline hollow iron having a 2.1 mm face thickness with a sole channel. Example 2 is a hollow iron with a 2.1 mm face with a rigid rod extending from the back portion to the striking face, also including a sole channel. Example 3 is a hollow iron with a striking face having a thick center (6.1 mm) and a thin perimeter (2.1 mm), also having a sole channel. Example 4 is a golf club head having an elastomer element similar to golf club head 100 depicted in FIGS. 1A-1C. The "Center" row indicates ball speeds resulting from a strike in the center of the golf club head, the "½" Heel" row indicates the loss of ball speed from a strike a half inch from the center of the club head towards the heel, and the "½" Toe" row indicates the loss of ball speed from a strike a half inch from the center of the club head towards the toe. All values in Table 1 are in miles per hour (mph).

TABLE 1

| Impact Location | Example 1 | Example 2 | Example 3 | Example 4 |
|---|---|---|---|---|
| Center | 134.1 | 132.8 | 133.8 | 133.6 |
| ½" Heel (drop from center) | −1.0 | −0.4 | −0.9 | −0.7 |
| ½" Toe (drop from center) | −6.9 | −6.5 | −6.8 | −6.7 |

From the results in Table 1, the golf club head with the elastomer (Example 4) displays a relatively high ball speed from the center of the face, while also providing a reduced loss of ball speed from strikes near the toe or the heel of the golf club.

In addition, as mentioned above, the type of material utilized for any of the elastomer elements discussed herein has an effect on the displacement of the striking face. For instance, an elastomer element with a greater elastic modulus will resist compression and thus deflection of the striking face, leading to lower ball speeds. For example, for a golf club head similar to golf club head 400A, Table 2 indicates ball speeds achieved from using materials with different elasticity properties. All ball speeds were the result of strikes at the center of the face.

TABLE 2

| Material | Elastic Modulus (GPa) | Ball Speed (mph) |
|---|---|---|
| Material A | 0.41 | 132.2 |
| Material B | 0.58 | 132.2 |
| Material C | 4.14 | 132.0 |
| Material D | 41.4 | 131.0 |

From the results in Table 2, a selection of material for the elastomer element can be used to fine tune the performance of the golf club. Any of the materials listed in Table 2 are acceptable for use in forming an elastomer element to be used in the present technology.

The different types of materials also have effect on the ball speed retention across the striking face. For example, for a golf club head similar to golf club head 400A, Table 3 indicates ball speeds achieved across the striking face from heel to toe for the different materials used as the elastomer element. The materials referenced in Table 3 are the same materials from Table 2. All speeds in Table 3 are in mph.

TABLE 3

| Material | ½" Toe Impact | Center Impact | ½" Heel Impact |
|---|---|---|---|
| No Elastomer Element | 128.7 | 132.2 | 129.4 |
| Material A (0.41 GPa) | 128.7 | 132.2 | 129.4 |
| Material C (4.1 GPa) | 128.7 | 132.0 | 129.3 |
| Material D (41 GPa) | 127.9 | 131.0 | 128.7 |

From the results in Table 3, materials having a higher elastic modulus provide for better ball speed retention across the striking face, but lose maximum ball speed for impacts at the center of the face. For some applications, a range of elastic moduli for the elastomer element from about 4 to about 15 GPa may be used. In other applications, a range of elastic moduli for the elastomer element from about 1 to about 40 or about 50 GPa may be used.

As mentioned above with reference to FIGS. 4A-4C, the size of the cradle may also have an impact on the ball speed. For a smaller cradle, such as cradle 408A in FIGS. 4A-4B, and an elastomer element made of a 13 GPa material, a loss of about 0.2 mph is observed for a center impact as compared to the same club with no elastomer element. For a larger cradle that is about 5 mm deeper, such as cradle 408C in FIG. 4C, and an elastomer element also made of a 13 GPa material, a loss of about 0.4 mph is observed for a center impact as compared to the same club with no elastomer element. For the same larger cradle and an elastomer element made of a 0.4 GPa material, a loss of only about 0.2 mph is observed for a center impact as compared to the same club with no elastomer element.

San Diego Plastics, Inc. of National City, Calif. offers several plastics having elastic moduli ranging from 2.6 GPa to 13 GPa that would all be acceptable for use. The plastics also have yield strengths that are also acceptable for use in the golf club heads discussed herein. Table 4 lists several materials offered by San Diego Plastics and their respective elastic modulus and yield strength values.

TABLE 4

| | ABS | Tecaform Acetal | PVC | Tecapeek | Tecapeek 30% Carbon Fiber |
|---|---|---|---|---|---|
| Thermoplastic Elastic Modulus (GPa) | 2.8 | 2.6 | 2.8 | 3.6 | 13 |
| Thermoplastic Compressive Yield Strength (GPa) | 0.077 | 0.031 | 0.088 | 0.118 | 0.240 |

Figure 5B:
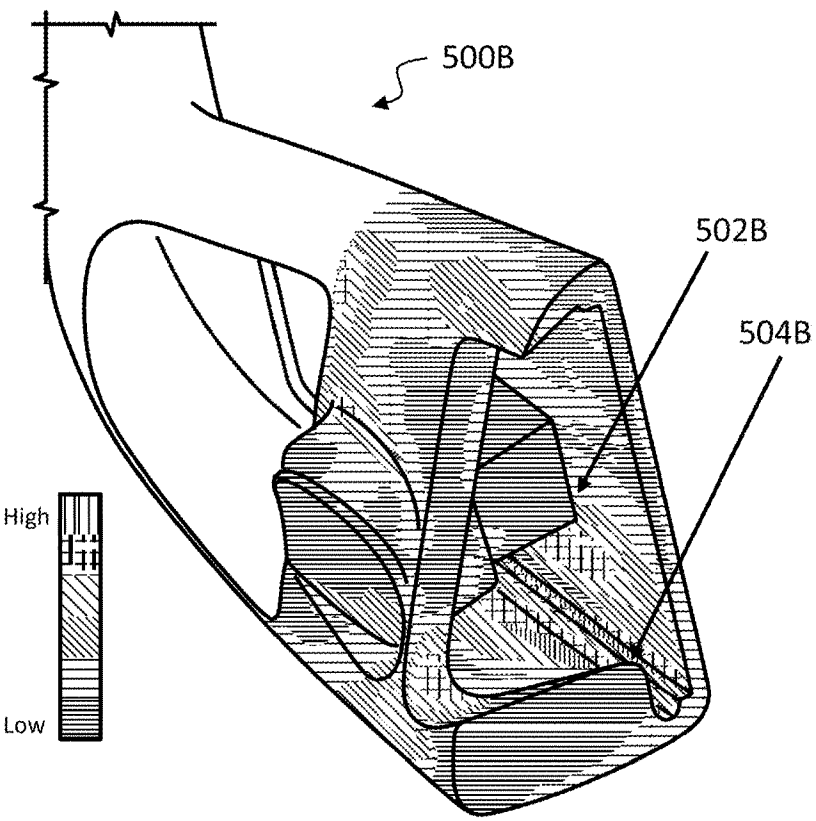
FIG. 5B depicts a stress contour diagram for a golf club head with an elastomer element.
Figure 5A:
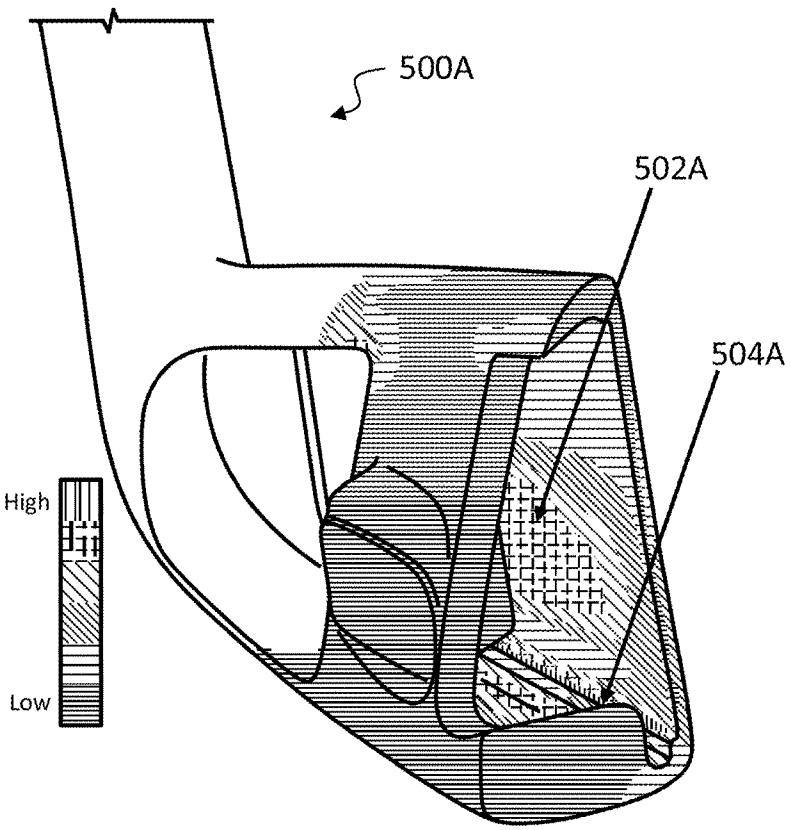
FIG. 5A depicts a stress contour diagram for a golf club head without an elastomer element.

The inclusion of an elastomer element also provide benefits in durability for the club face by reducing stress values displayed by the striking face upon impact with a golf ball. FIG. 5A depicts a stress contour diagram for a golf club head 500A without an elastomer element, and FIG. 5B depicts a stress contour diagram for a golf club head 500B with an elastomer element. In the golf club head 500A, the von Mises stress at the center of the face 502A is about 68% of the maximum von Mises stress, which occurs at the bottom face edge 504A. Without an elastomer element, the von Mises stress levels are high and indicate that the club face may be susceptible to failure and/or early deterioration. In the golf club 500B, for an elastomer element having an elastic modulus of 0.41 GPa, the von Mises stress for the face near the edge of the elastomer element 502B is reduced by about 16% and the maximum von Mises stress occurring at the bottom face edge 504B is reduced by about 18%. These von Mises stresses are still relatively high, but are significantly reduced from those of the golf club head 500A. For a golf club head 500B with an elastomer element having an elastic modulus of about 13 GPa, the von Mises stress for the face near the edge of the elastomer element 502B is reduced by about 50% and the maximum von Mises stress occurring at the bottom face edge 504B is reduced by about 56%. Such von Mises stress values are lower and are indicative of a more durable golf club head that may be less likely to fail.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. An iron-type golf club head, comprising:

a club head body having a back portion and a striking face;

an adjustment receiver attached to the back portion and an adjustment driver inserted into the adjustment receiver;

a cradle in contact with an end of the adjustment driver such that movement of the adjustment driver causes movement of the cradle; and an elastomer extending from the cradle towards a rear surface of the striking face, wherein the elastomer contacts a portion of the rear surface of the striking face at a geometric center of the striking face.

2. The iron-type golf club head of claim 1, wherein the adjustment driver comprises a screw having a screw drive at least partially external to the club head body and wherein an end of the screw opposite the screw drive is in contact with the cradle.

3. The iron-type golf club head of claim 2, wherein the adjustment receiver comprises a threaded hole in the back portion for receiving the screw such that turning of the screw adjusts the compression of the elastomer.

4. The iron-type golf club head of claim 1, wherein the elastomer displays an elastic modulus of about 1 to about 40 gigapascals (GPa).

5. The iron-type golf club head of claim 1, further comprising a sole connecting the back portion to the striking face, wherein the sole at least partially defines a channel.

6. The iron-type golf club head of claim 1, wherein the cradle encompasses at least 25% of a volume of the elastomer.

7. The iron-type golf club head of claim 1, wherein the elastomer is frustoconical and the cradle is formed to substantially match a shape of a rear portion of the elastomer.

8. The iron-type golf club head of claim 1, further comprising a securing structure attached to the rear surface of the striking face, the securing structure configured to secure the elastomer to a position on the rear surface of the striking face.

9. An iron-type golf club head comprising:

a club head body having a back portion and a striking face, wherein a cavity is formed between the striking face and the back portion;

an elastomer in contact with a rear surface of the striking face; and an adjustment mechanism operatively connected to the elastomer, wherein the adjustment mechanism is configured to adjust a compression of the elastomer, and wherein the adjustment mechanism includes:

an adjustment driver, the adjustment driver defining a recess that at least partially encompasses a rear portion of the elastomer; and an adjustment receiver formed in the back portion, the adjustment receiver defining a through hole into the cavity, wherein the through-hole is configured to receive the adjustment driver.

10. The iron-type golf club head of claim 9, wherein the adjustment driver comprises a screw having a screw drive at least partially external to the club head body.

11. The iron-type golf club head of claim 10, wherein the through hole is a threaded hole for receiving the screw such that turning of the screw adjusts the compression of the elastomer.

12. The iron-type golf club head of claim 11, wherein the interface includes a cradle at least partially encompassing the elastomer, wherein the cradle is in contact with the adjustment mechanism.

13. The iron-type golf club head of claim 9, wherein the elastomer displays an elastic modulus of about 1 to about 50 GPa.

14. The iron-type golf club head of claim 13, wherein the elastomer displays an elastic modulus of about 4 to about 15 GPa.

15. The iron-type golf club head of claim 9, wherein a portion of the striking face in contact with the elastomer has a thickness different from a thickness of another portion of the striking face.

16. The iron-type golf club head of claim 9, further comprising a securing structure attached to the rear surface of the striking face, the securing structure configured to secure the elastomer to a position on the rear surface of the striking face.

17. The iron-type golf club of claim 16, wherein the securing structure is at least one of a flange, a plurality of posts, or an adhesive.

18. The iron-type golf club of claim 9, wherein at least one of the recess of the adjustment driver and the rear portion of the elastomer is lubricated to prevent twisting of the elastomer element during adjustment of the adjustment mechanism.

19. A kit for assembling an iron-type golf club, the kit comprising:

a club head body having a back portion and a striking face;

an elastomer having a first portion in contact with a rear surface of the striking face and a second portion in contact with a cradle;

a set of differently weighted adjustment drivers, wherein the set of differently weighted adjustment drivers comprises adjustment drivers having different lengths configured to provide different maximum compressions of the elastomer; and an adjustment receiver incorporated in the back portion, wherein the adjustment receiver is configured to receive an adjustment driver from the set of differently weighted adjustment drivers that, when manipulated, adjusts a compression of the elastomer between the back portion and the striking face.

20. The kit of claim 19, wherein the set of differently weighted adjustment drivers comprises a set of differently weighted screws, and wherein the adjustment receiver is a threaded hole extending through the back portion.

* * * * *